US006957455B1

(12) United States Patent
Misson

(10) Patent No.: US 6,957,455 B1
(45) Date of Patent: Oct. 25, 2005

(54) SAFETY BUMPER FOR USE WITH A CHILD'S BED

(76) Inventor: Anita Misson, 2948 E. Bradford Pike, Marion, IN (US) 46982

( * ) Notice: Subject to any disclaimer, the term of this patent is extended or adjusted under 35 U.S.C. 154(b) by 199 days.

(21) Appl. No.: 10/670,080

(22) Filed: Sep. 24, 2003

(51) Int. Cl.[7] ..... A47C 21/08

(52) U.S. Cl. ..... 5/425; 5/424; 5/426; 5/663; 5/946

(58) Field of Search ..... 5/424–426, 946, 5/663

(56) References Cited

U.S. PATENT DOCUMENTS

| | | | | | |
|---|---|---|---|---|---|
| 5,010,611 | A | * | 4/1991 | Mallett | 5/497 |
| 5,706,534 | A | * | 1/1998 | Sherman | 5/424 |
| 5,933,885 | A | * | 8/1999 | Glassford | 5/424 |
| 5,960,493 | A | * | 10/1999 | Rhey et al. | 5/424 |
| 6,178,573 | B1 | * | 1/2001 | Wagner et al. | 5/424 |
| 6,564,403 | B1 | * | 5/2003 | Titus | 5/425 |

* cited by examiner

*Primary Examiner*—Teri Pham Luu
(74) *Attorney, Agent, or Firm*—E. Victor Indiano; Indiano, Vaughan Roberts & Filomena, LLP

(57) ABSTRACT

The safety bumper is useable with a child's bed. The safety bumper is receivable by and placeable on a mattress, and comprises a fitted mattress engaging portion and a bumper portion. The mattress engaging portion includes a ring-like underside surface engaging portion for engaging the underside surface of the mattress. The mattress engaging portion defines an opening. An endless side surface engaging portion is provided for engaging each of the first and second opposed side surfaces, and the first and second opposed end surfaces of the mattress. An elastic member is capable of extending chordally along the underside surface of the mattress between a pair of opposed points of the endless side surface engaging portion. The bumper portion comprises an endless ring capable of being disposed adjacent to the first and second opposed side surfaces, and the first and second end surfaces of the mattress. The upstanding bumper portion is configured for extending in planes generally coplanar with the first and second opposed side surfaces, and the first and second end surfaces of the mattress, above the upper side surface of the mattress.

6 Claims, 8 Drawing Sheets

SAFETY BUMPER FOR USE WITH A CHILD'S BED

I. FIELD OF THE INVENTION

The present invention relates to bedding accessories, and more particular to a safety bumper of the type that is useable in connection with a child's bed, and particularly, a child's crib, that provides a cushioning member adjacent to the sides of the mattress and the headboard, footboard and side rails of a bed for helping to prevent injury to the baby.

II. BACKGROUND OF THE INVENTION

Individuals often use baby cribs as a way of keeping a child safe when the child is sleeping. Like an adult bed, a baby crib includes a frame that includes a generally horizontally disposed mattress frame having an upper surface upon which a mattress rests. A headboard is connected at one end of the mattress frame, and a footboard is connected at the other end of the mattress frame. Also similar to an adult bed, the mattress is often overlain with sheets, blankets, and other accessories that may be primarily decorative in nature.

However, a crib differs substantially from a normal adult bed in other important respects. One way in which they differ is that a crib is often designed to have the mattress elevated at a level that is substantially higher than a normal bed, in order to make it easier for a parent to attend to a baby sleeping in the crib. Another difference is that both the headboard and footboard of a crib usually extend upwardly to a position substantially above the top of a mattress surface. This feature is provided for serving as a barrier, for preventing the baby within the crib for falling out of the crib.

Another important difference between an adult bed and the crib, is that a crib will often have side rails that, similar to the headboard and footboard, extend substantially above the level of the mattress. The distance to which the side rails, headboard and footboard extend above the level of the mattress is usually a matter of personal choice, and is often determined by the age and activity level of the child. For example, as newborns are generally immobile, the top of the rail may only extend a foot or so above the level of mattress. However, as toddlers are substantially more active, and have usually acquired sufficient mobility skills to pull themselves upright, a mattress will be positioned to have its upper surface often placed at a level of 18 to 30 inches below the upper surface of a rail, to prevent the toddler from injuring himself. At this level, the side rails and headboards become a tall enough "fence" to keep the toddler from hoisting himself over the top of the rails and falling to the ground.

On many cribs, the side rails are slideable upwardly and downwardly, to facilitate the placement of a baby into the crib and the removal of the baby from the crib. Even though cribs often provide a safe place for a child to sleep that helps to prevent the child from becoming injured, room for improvement exists in helping to keep a child safe within a crib. One way that a child can become injured in a crib is by the child being caught between the mattress and the bed rails of the crib.

Many cribs currently on the market have vertical side rails that, as discussed above, help prevent the child from falling out the crib while sleeping. Unfortunately, most rail containing side rails are designed to have spaces between adjacent rails. A child's head, arms or legs can gain access to these spaces between the rails, and become caught therein. Additionally, children can have their head, arms or legs caught in the space that exists between the side edge of the mattress and the rails. Usually, the rails are made a fairly stiff and unyielding material, such as metal or wood, that may enable a child to become injured, should the child fall against them.

To overcome this problem, several persons have introduced and produced baby crib bumpers. The purpose of these bumpers is to help prevent the baby from banging their head against the rail and then becoming injured. Additionally, bumpers are usually designed to help prohibit the child from being able to put his head, arms and/or legs through the spaces between the rails. Most prior art bumpers known to Applicant are typically anchored to the rails with ties, that can be tied around the rails. Unfortunately, many of these bumpers suffer the drawback of not being able to be securely positioned. As such, the bumpers often can move, to thereby allow an access space between the mattress and the underside of the bumper pad. Additionally, many bumper pads do not fit properly, thus increasing the possibility that the child can place his hand, arm or leg in the space between the mattress and the bumper pad, to thereby injure himself, or permit his arm or hand to be caught between the mattress and the rail.

Other baby crib bumpers of which the Applicant is aware are designed so that the bumper pad is affixed to the crib itself by a plurality of fasteners, as opposed to being affixed to the mattress within the crib. Although this type of bumper pad has the advantage of enabling the parent to change the baby crib sheet without having to remove the bumper pad, it creates a new set of problems since the multiple fasteners have the propensity to increase the risk of choking, should the child be able to access one of the many fasteners. Additionally, crib bumpers of this type often require multiple steps to position the bumper properly within the mattress, and may require the use of an additional padded sheet.

Still other baby crib bumpers known to the Applicant are attached to a fitted sheet, that then fits into the crib over the mattress. The problem created by these types of bumper pads, is that since the baby bumper pad is manufactured as an integral part of the fitted sheet, the bumper pad must be removed and washed whenever the fitted sheet requires laundering.

An additional disadvantage of this type of bumper pad is that it limits the decorative choices of the parent, since the crib sheet used by the parent must be the one that accompanies the bumper. As such, a parent cannot choose to use a separate type fitted sheet without foregoing the use of the bumper pad.

Although the above described bumper pads, in many cases, serve their intended functions well, room for improvement exists. In particular, room for improvement exists in providing a baby bumper pad that securely attaches to a crib mattress in a way that securely positions the bumper pad in the crib. Additionally, room for improvement exists in providing a baby bumper pad that reduces the ability of the baby to get its arm, leg or head caught in the rail, or in the space between one of the side and/or head rails and the mattress. Still another area in which room for improvement exists is in providing a bed sheet that can be securely attached to a crib mattress without being an integral part thereof, so as to afford the user greater flexibility in choosing sheets, without the need to purchase integral bumpers; and to be able to change and launder sheets without also being required to launder the attached bumper.

It is therefore one object of the present invention to provide a baby bumper that improves over the known prior art, and addresses one or more of the issues discussed above.

SUMMARY OF THE INVENTION

In accordance with the present invention, the safety bumper is provided for use with a child's bed. A safety bumper is receivable by, and is placeable on a mattress having an upper surface, an underside surface, first and second opposed side surfaces, and first and second opposed end surfaces. The safety bumper comprises a fitted mattress engaging portion, and a bumper portion. The mattress engaging portion includes a ring-like under side surface engaging portion for engaging the under side surface of the mattress. The mattress engaging portion defines an opening. The mattress engaging portion also includes an endless side surface engaging portion for engaging each of the first and second opposed side surfaces, and the first and second opposed end surfaces. Additionally, the mattress engaging portion includes an elastic member capable of extending chordally across the underside surface of the mattress between a pair of opposed points on the mattress engaging portion.

The bumper portion comprises an endless ring capable of being disposed adjacent to the first and second opposed side surfaces, and the first and second end surfaces. The safety bumper is configured for extending in a plane generally coplanar with the first and second opposed side surfaces and the first and second opposed end surfaces of the mattress, and to extend above the upper side surface of the mattress. The bumper portion includes a divider for defining at least two pockets for containing the cushioning material. The at least two pockets are configured for providing substantially endless upstanding cushioning bumpers.

Preferably, the safety bumper comprises an endless ring, that, when coupled to a mattress, comprises a generally rectangular ring having first, second, third and fourth arcuate corners. An elastic bed-engaging strap member is attached to the bumper portion adjacent at least one of the first, second, third and fourth corners. The elastic strap member is attachable to a bed post frame.

One feature of the present invention is that it includes a mattress underside surface engaging member that comprises an open ring having at least two opposed sides that are coupled together by at least one, and preferably two chordally extending elastic members. This feature has the advantage of enabling the baby bumper to be easily fit over a mattress, and also to make the device more adaptable to mattresses of different sizes. In this regard, the primary size differences encountered are differences in fullness and thickness of different brands and models of mattresses.

One difficulty with some of the known baby bumpers is that they have been difficult to place on, and remove from, a crib of a mattress. To some extent, this difficulty has been caused by many prior art devices including a solid, underside member. This solid underside member requires the user to place the bumper on the frame, and then to set the mattress over the underside surface. It will be appreciated that this operation in many cases requires the mattress to be entirely removed, and lifted out of the crib.

Another difficulty that is encountered is that crib mattresses often do not have standard fullnesses and thicknesses.

Because the underside surface engaging member of the present invention largely consists of an open ring, it is much easier for the user to affix the baby crib bumper to the mattress without being forced to remove the mattress. Additionally, due to the elastic nature of the chordally extending elastic members, the device can accept and adapt to mattress members of varying sizes.

Another feature of the present invention is that the thickened, padded cushion members are disposed adjacent to the side of the mattress, and are designed to partially overlay the edge of the mattress. This feature has the advantage of better isolating the baby from the space between the edge of the mattress and the side rails and headboard, thus reducing the likelihood that the baby will get his head, arm or other body part caught in that space. Additionally, the present invention provides no space between the top side of the mattress and the bottom edge of the bumper that would permit the baby to gain direct access to the rails.

A further feature of the present invention is that it is formed as an endless ring. This feature has the advantage of making the device more easy to position on a bed, and more stable by not requiring the use of fasteners to fasten two ends of a linear bed crib member together.

It is also a feature of the present invention that the safety bumper of the present invention is designed to fit over a fitted sheet, and to be entirely separate from the crib sheet. One advantage this feature provides is that it enables the sheet and safety bumper to be laundered separately. As such, a single safety bumper can be used with a plurality of sheets, which, also, gives the user a wider variety of sheets from which to choose. In this regard, it has been the Applicant's experience that crib sheets often need to be laundered significantly more frequently than bumper pads. The separability of the mattress and the bumper pad obviates the need for the user to wash the safety bumper each time that the crib sheet is washed.

A further feature of the present invention is that it includes plastic members for securing the safety bumper to a bed frame member. The use of these elastic members has the advantage of enabling the safety bumper to be used with a wider variety of bed frame types. In recent years, bed post frame having relatively wider bed posts have become fashionable. Because of these larger bed posts, many safety bumpers not having elastic bed post engaging members, or otherwise having relatively short bed post engaging members, are incapable of being attached to the bed post effectively.

These and other features of the present invention will become apparent to those skilled in the art upon a review of the detailed description and drawings set forth below, which set forth the best mode perceived presently by the Applicant of practicing the invention.

IV. BRIEF DESCRIPTION OF DRAWINGS

V. DETAILED DESCRIPTION

Figure 3:
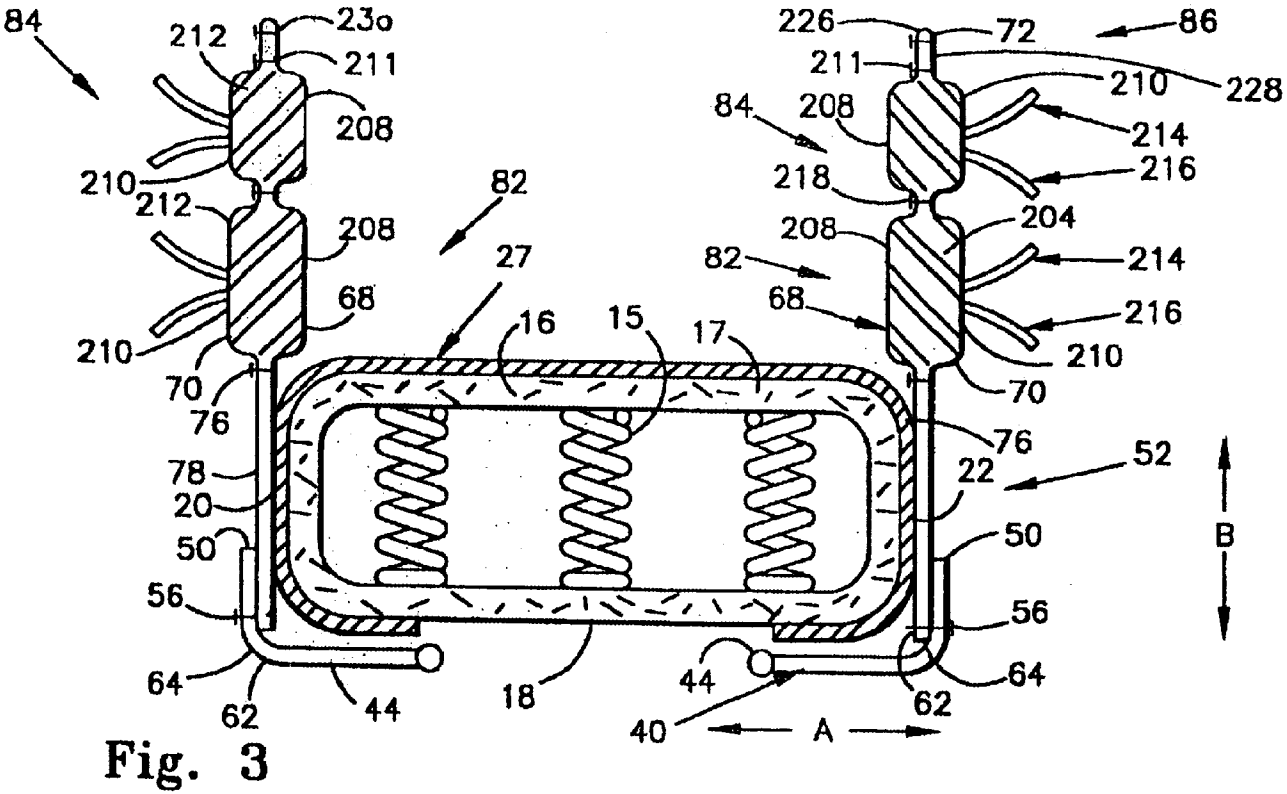
FIG. 3 is a sectional view taken generally along lines 3—3 of FIG. 1.
Figure 4:
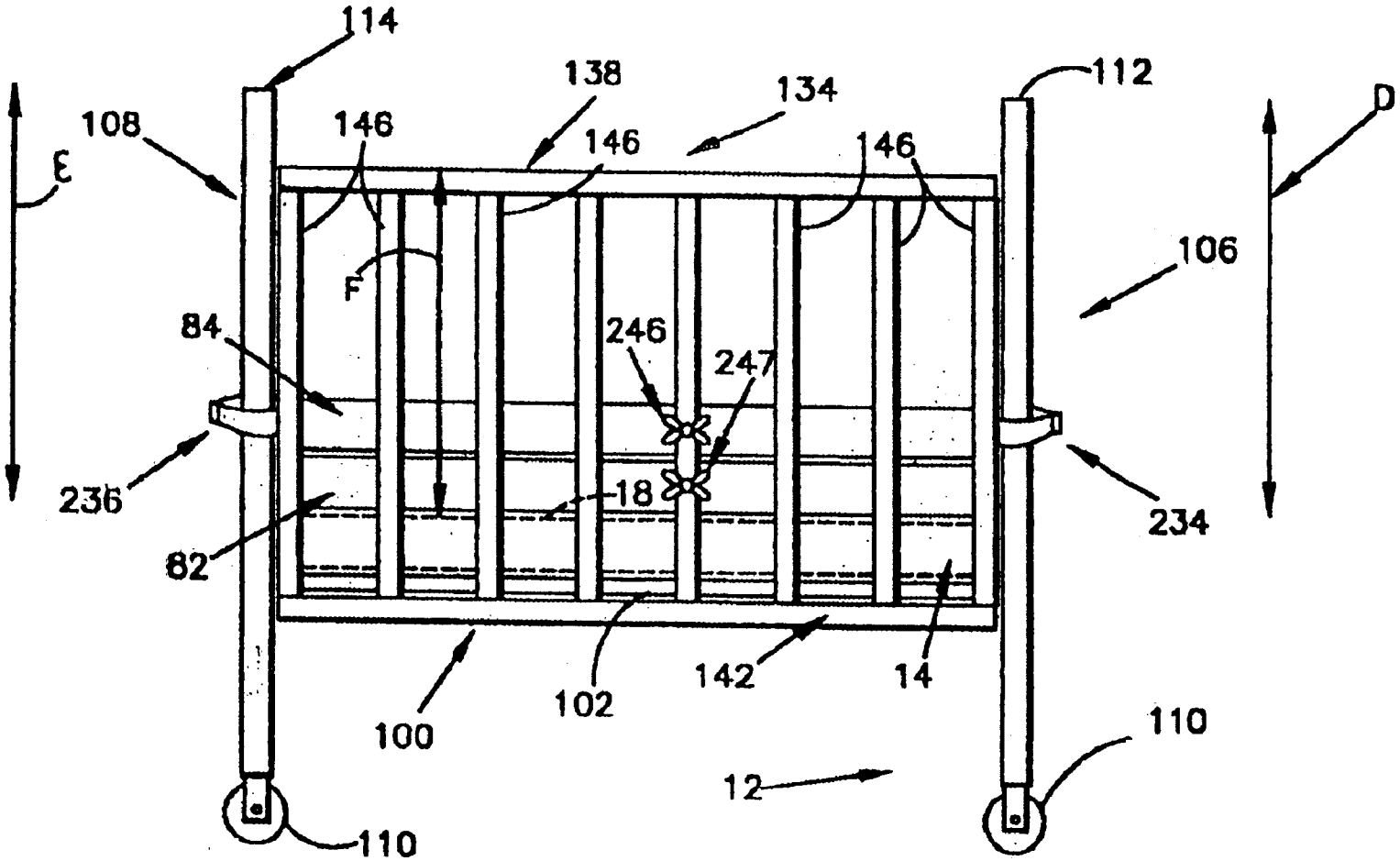
FIG. 4 is a side view of the safety bumper of the present invention as installed on a mattress (shown in phantom) in a typical baby crib.

The safety bumper 10 of the present invention is shown for use in connection with a child's bed, and particularly, a crib 12 (FIG. 4). The safety bumper 10 is designed to be received by and placed adjacent to a mattress 14 (FIG. 3). The mattress 14 is a conventional crib mattress having conventional construction. Although mattresses, such as mattress 14 can be constructed in a variety of ways, the mattress 14 is shown as having a plurality of inner springs 15 that is overlain by a pad 17 to provide a cushion for the springs 15.

The mattress 14 includes an upper side surface 16 that is the surface upon which a baby is placed for sleeping when in the crib 12. An underside surface 18 is designed to fit within the bed, and engages a bed frame member 102 (FIG. 5) that itself includes a generally horizontally disposed surface for engaging the underside surface 18 of the mattress 14, and thereby supporting the mattress 14 above the ground. The mattress also includes an endless side surface that is generally rectangular in shape, but includes arcuate corners. As with all rectangles, there are four primary surfaces, including a first side surface 20, a second side surface 22, a first end surface 24, and a second end surface 26.

A fitted sheet 27 is sized and configured for being received upon the mattress 14. Most fitted sheets include an upper side surface for being placed adjacent, and on top of the upper side surface 16 of the mattress 14, side surfaces for being disposed adjacent to the first and second side surfaces 20, 22 of the mattress; and first and second end surfaces 24, 26. The corners of the fitted sheet are designed to be arcuate, and to include a portion that extends for a short distance under the underside surface 18 of the mattress 14, to better secure the fitted sheet 27 onto the mattress 14.

Most fitted sheets include either an endless elastic ring that is disposed at the terminal end of the underside surface engaging portion of the fitted sheet, or else four elastic segments, that are disposed, one at each corner of the fitted sheet. This elastic member helps to hold the fitted sheet 27 onto the mattress 14, and helps to prevent it from becoming "untucked" as a flat sheet is prone to do.

Figure 5:
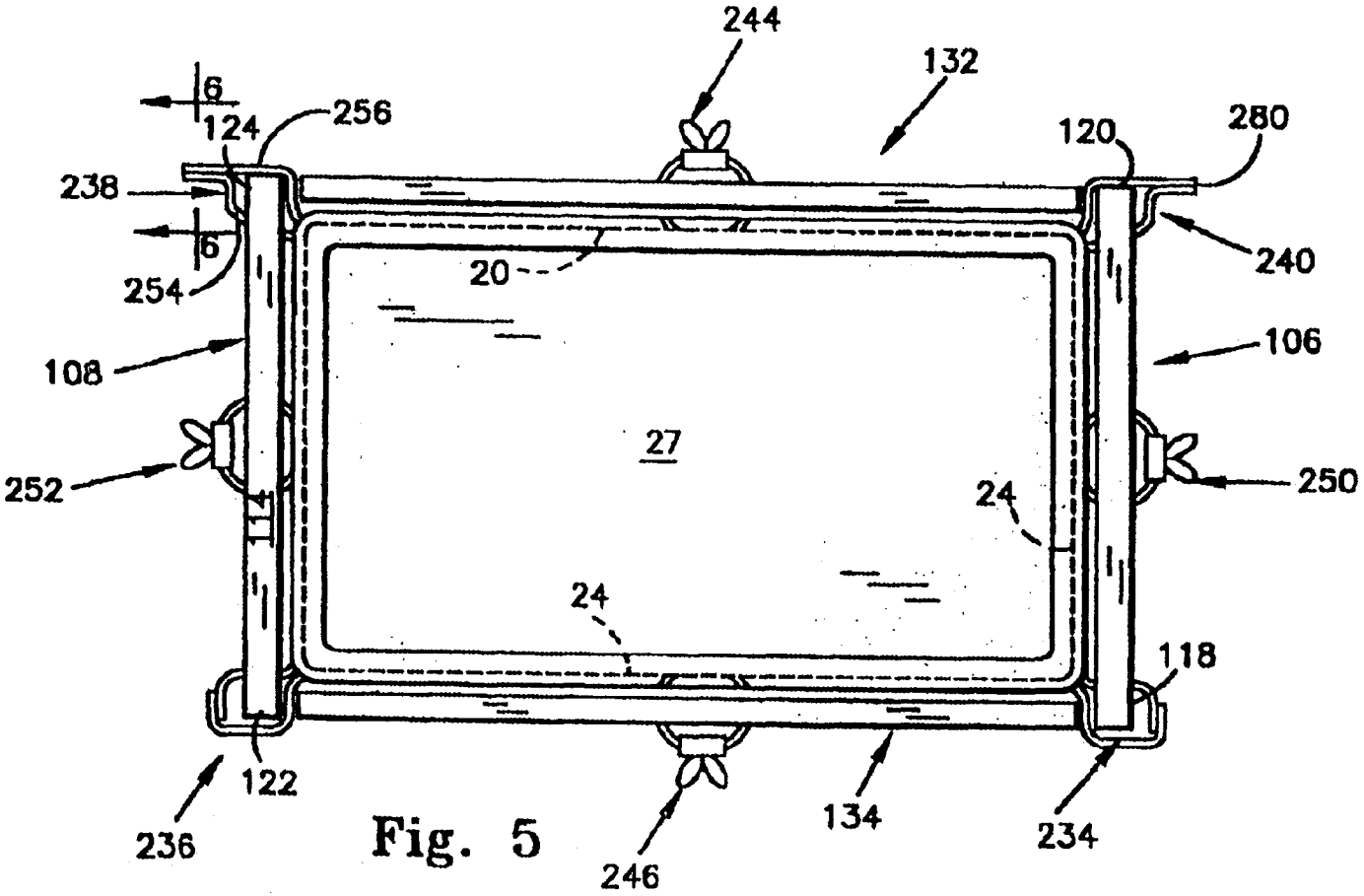
FIG. 5 is a top view of the safety bumper installed on a mattress and crib.

As best shown in FIGS. 4 and 5, the crib 12 includes a multi-component frame 160, one component of which is a horizontally disposed supporting frame 102, that includes an upper surface upon which the underside surface 18 of the mattress 14 rests. The horizontally disposed frame can be a solid material, such as a board, or else a flat spring containing member.

The frame 100 also includes a generally upright, vertically disposed headboard 106 and a upright, generally vertically disposed footboard 108. The headboard 106 and footboard 108 may be supported above the ground by two or four casters 110, that permit the bed to be rolled along a horizontal surface, such as a floor or hallway. Alternately, if the user does not desire the crib 12 to be rollable, the casters can be eliminated.

The upright headboard 106 and upright footboard 108 each include upper ends 112, 114, respectively, that may comprise generally horizontally extending planks or rails, as shown in the crib 12 of the drawing; or otherwise, can comprise the upper end of a solid board. Importantly, it will be noted that the upper surfaces 112, 114 of the headboard 106 and footboard 108 extend substantial distances D, E above the upper surface 18. As discussed above, this placement of the upper ends 112, 114 of the headboard and footboard, 106, 108 at substantial distances D, E above the upper side surface of mattress 18 causes the crib to form an open-topped cage, that helps to avoid injury to the baby, at distances D, E should preferably be great enough to prohibit the baby from climbing there over, and thus becoming injured in the fall. As also discussed above, the distances D and E are usually adjustable in cribs, with distances D and E being shortened for newborn infants lacking any significant mobility, and lengthened for toddlers who possess the strength, skill, mobility and dexterity to have the reasonable potential to climb over the headboard 112 and footboard 114, or side rails.

In the crib 12 shown in the drawings, each of the headboard 106, and footboard 108 comprise a plurality of generally vertically extending, parallel spaced rails, that have a general appearance that is similar to the first and second side rails 132, 134 (FIG. 4). These vertically extending rails include four corner posts, including first and second corner posts 118, 120 of the headboard 106, and first and second corner posts 122, 124 of the footboard 108. As will be discussed in more detail below with respect to the corner post engaging straps, recent fashion designs have trended toward making the corner posts larger and more substantial, than corner posts that may have existed in bygone eras.

First and second vertically slideable side rails 132, 134 extend between the headboard 112 and the footboard 114 respectively. First side rail 132 is disposed in a spaced, generally parallel relation to the first side surface 20 of the mattress 14, and the second side rail 134 is disposed in a spaced, parallel relation to the second side surface 24 of the mattress 14. Both of the side rails 132, 134 extend generally vertically, and are disposed in generally parallel planes with the respective side surfaces 20, 24.

The side rails 132, 134 that are shown in the drawing each include a horizontally disposed bottom rail, and a horizontally disposed top rail 136 that is disposed generally parallel with the bottom rail 138. A plurality of upstanding, vertically extending spaced, parallel side rails 146 exist in a spaced array. Rails are often employed because their semi-transparency (due to the spaces between adjacent rails) enables the child care giver to better watch the movement of the infant from a distance, without the need for standing directly over the infant, as would be likely if the side rails 132, 134 were made from a solid piece of wood, metal or the like.

The side rails 132, 134 are usually track mounted, and slideable vertically between an upright position, (as shown in FIG. 4) and a lowered position. When in the upright position, the distance F between the top of the top rail 138 and the mattress surface 18 is significant, for the same reasons as set forth above in connection with the distances D, E of the headboard 12 and footboard 114. However, the side rails 132, 134 can be lowered on its tracks to make it easier for the user to gain access to the infant, to place him in the crib or remove him from the crib.

The safety bumper 10 includes three primary components, including a mattress engaging portion 30, for securing the safety bumper 10 onto the mattress 14, a bumper portion 34 and one or more chordally extending elastic members 36, that extend between opposed points of the mattress engaging portion 30 of the safety bumper 10.

Figure 1:
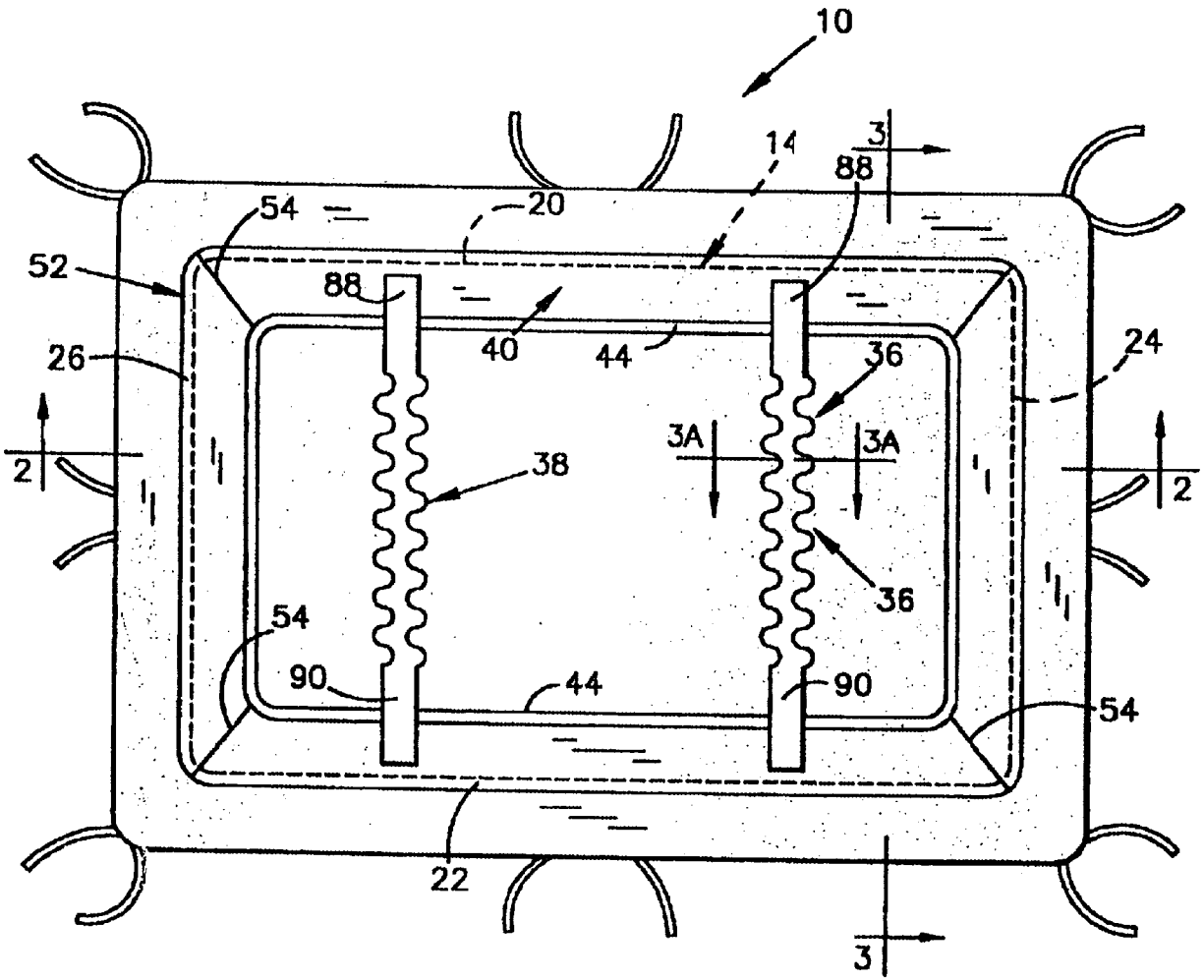
FIG. 1 is a bottom view of the safety bumper of the present invention.

As best shown in FIGS. 1, 3 and 5, the mattress engaging portion 30 includes a ring like underside engaging surface 40. According to a preferred construction of the device 10, the ring like engaging surface 40 is made to have a single sheet thickness. Because of its position between the underside surface of the mattress and the bed frame, the underside surface engaging portion 40 need not be decorated identically to the remainder of the bumper 10, nor does it need to have much attention or expense paid to decoration, as the underside engaging portion 40 is rarely seen when in use.

The ring like underside engaging surface 40 includes an inner seam 34, that is disposed at its inner most point. In lieu of a seam 44, a fabric-covered elastic member can be employed for the inner seam 44. The inner seam 44 defines the opening of the ring, and unlike many prior art safety bumpers, does not entirely cover the underside surface of the mattress 14. As shown in the drawings, the underside engaging surface 40 can be formed of four separate fabric pieces, having angled corners that are sewn together at darts 54, to form the corners of the underside engaging member 40.

The underside engaging member 40 also includes an upper edge that extends vertically for a short distance, and that is fixedly coupled, such as by sewing to the side engaging surface 52 by a line of stitches 56. Although the stitches 56 are shown in FIG. 3 as having a "nail" shape for purposes of clarity, the actual stitches are conventional and appropriate for the fabric and stress loads placed on the bumper 22. It will be appreciated that in order to make the line of stitches 56 secure the side engaging portion 52 and underside engaging portion 40 together, there preferably exists some overlap between the upper edge 50 of the underside engaging portion 40, and the lower edge of the side engaging portion 52.

Although the effective length, as measured along line A of FIG. 3 of the underside engaging portion 40 can be variable, the Applicant has found that the effective length is preferably between about 6 and 8 inches. Although the effective length A of the underside engaging portion 40 can be somewhat longer or shorter, the Applicant has chosen the above range, as it appears to Applicant to achieve maximum efficiency.

If the effective length A of the underside engaging portion 40 is too long, (e.g. 14 inches), one runs into difficulties in attaching the safety bumper 10 to the mattress 14 as discussed in connection with some of the prior art devices above. On the other hand, if the effective length A is too short (e.g. 1 inch), the underside engaging portion 40 is not provided with enough area and hence frictional engagement to securely grip the mattress 14, thus increasing the likelihood that the underside engaging portion 40 will become disengaged from the mattress 14, and present an "untucked" and thereby sloppy appearance.

The side engaging surface portion 52 is formed integrally with the first and second bumpers 82, 84 and the crowning ruffle 86, and is preferably made from a bed sheet type linen or cotton material. As best shown in FIG. 3, this integral sheet includes a first end 62 that is the lower most portion of the inwardly facing surface of the bumper pad 10. The sheet extends continuously, to become the interior surface of the first bumper member 82, the second bumper member 84, and the interiorly facing surface of the crowning ruffle 86. At the top most portion of the sheet exists a central fold 72 which, approximately divides the unitary sheet in half. The unitary sheet then continues downwardly, to form the outwardly (exterior) facing surfaces of the second bumper 84, first bumper 82 and side engaging surface 52.

A line of stitches 76 serve as the demarcation line between the side engaging surface 52, and the first and second bumpers 82, 84. The line of stitches 76 extends along the line, that generally defines the furthest upward extent of the side edge portion 52.

It will be noted that the first and second sheets that comprise the side edge portion 52 define a hollow pocket 78 therebetween. Because the side edge portion 52 is placed between the side edge surface of the mattress 14 and the rail (not shown), the width of the side edge portion 52 is generally very thin, and the pocket 78 is usually devoid of any additional cushioning material. Usually, the thickness, when measured in a direction (but not an extent) generally similar to arrow A is rarely greater than the thickness of two sheets of material that are placed on top of each other. As will be appreciated, different materials that could be used for the safety bumper 10 will have different thicknesses, and as such, the thickness of the side edge portion will generally be dependant upon the thickness of the material used to make the continuous sheet.

The length, measured in a direction indicated generally by arrow B of the side engaging portion 52 is generally similar to the height as measured also in a direction indicated generally by arrow B of the mattress 14. Nonetheless, it will be noted that the line of stitches 76 is preferably placed just below the corner of the upper side surface 18 of the mattress 14, so that the lower end of the relatively thicker first bumper portion 82 engages the outer edge of the upper side surface 18, and possibly a small portion of the side surfaces 27, 24 of the mattress 14. This placement helps to place the lower bumper 82 in a close and tight engagement with the "corner" of mattress 14, that thereby makes it more difficult for a baby to get his hand or arm caught between the side edge surface 22 of the mattress and the inwardly facing interior surface of the side engaging portion 52 of the safety bumper.

As best shown in FIG. 1, the elastic members 36, 38 each include a first end 88 and a second end 90. The first end 88 is fixedly attached, such as by sewing, to the ring-like underside engaging surface 40. Similarly, the second end 90 is also fixedly sewn to the ring-like underside engaging surface 40. The elastic members 38, 36 extend chordally between two opposed points on the ring-like underside engaging surface 40, to span the opening formed by the ring-like underside engaging surface.

Figure 3A:
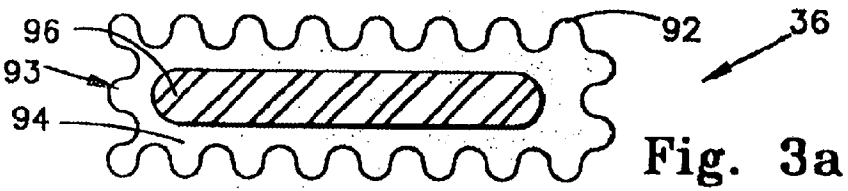
FIG. 3A is a sectional view taken along lines 3A—3A of FIG. 1.

Turning now to FIG. 3A, the construction of the elastic members will be discussed. The elastic members 36 generally include a single fabric sheet 92 that has its ends sewn together at seam 93 to form a fabric tube having a hollow interior 94. An elastic strip 96 is disposed within the hollow interior of the tube. The elastic strap is preferably anchored, along with the fabric 92 at the first and second ends 88, 90 to the ring-like engaging portion 40. It should be noted that the fabric tube 92 has a significantly longer length than the elastic member when in its rest position so that a sufficient length of fabric 92 is available when the elastic strap 96 stretches.

Preferably, the elastic band 96 is designed to provide a significant amount of stretch, as a significant amount of stretch helps the user to place the safety bumper 10 upon the mattress. For example, the stretch should be significant enough, to enable the user to lift one end of the mattress and to insert the mattress in the space between elastic members 36 and 38. Assuming that the user first inserts the end of the mattress adjacent to side end 26 in the space between elastic members 36 and 38, the user can then pull the safety bumper over the mattress, with one end lifted, until the end of the safety bumper adjacent to side surface 26 of the mattress is properly positioned. At that point, the user can then set the mattress back into the crib, and lift the second end of the mattress, adjacent to side edge surface 24, and insert it into the void between elastic bumpers 36, 38, stretch out the elastic bumper 36 so that it goes over the mattress, and insert the end 24 of the mattress 14 within the safety bumper, so that it is received by the safety bumper. The user can then drop this end 24 of the mattress into the crib. At that point, the safety bumper will be appropriately affixed onto the mattress 14. Alternately, some users find it easier to affix the bumper 10 when the mattress is removed from the crib 12.

From the foregoing discussion, it will be appreciated that the elastic members 36, 38 should be able to stretch, a significant distance, to enable the user to perform the operation described above, wherein one elastic member (e.g. 36) can be pulled over the end of the mattress 24 even though the other end 26 of the mattress is engaged to the safety bumper 10. On the other hand, the rest length of the elastic member 36 should still be small enough so that some tension will be exerted by the elastic members 36, 38 on the underside engaging portion 40, to prevent the underside engaging portion 40 from becoming disengaged from the mattress and assuming an un-tucked appearance.

Figure 2:
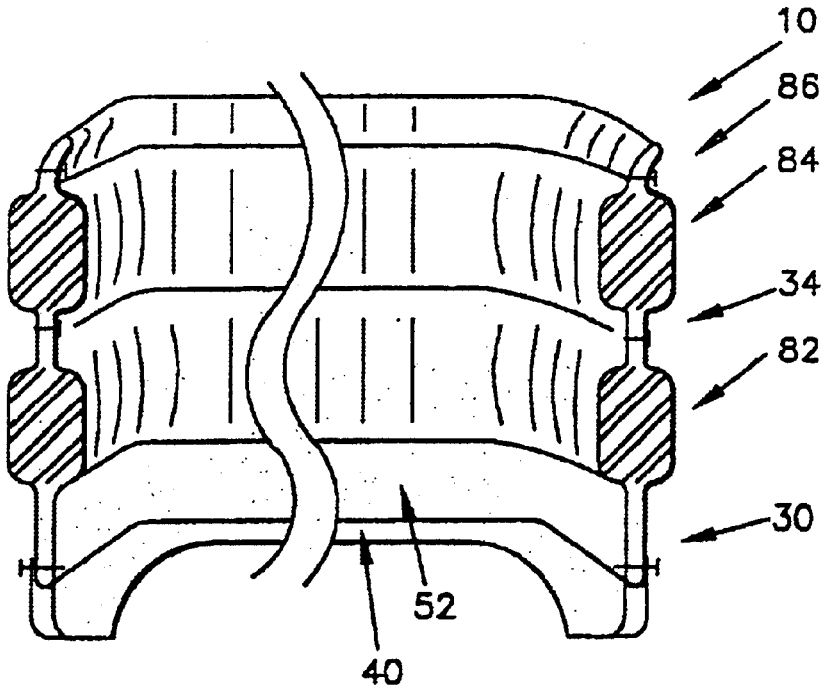
FIG. 2 is a sectional view taken generally along lines 2—2 of FIG. 1.

The safety bumper portion, including first and second safety bumper members 82, 84 are best described with reference to FIGS. 2, 3 and 4. The first, or lower safety bumper member 82 includes an interior sheet portion 200 and an exterior sheet portion 202, that define a pocket into which is inserted a fiber fill 204. A sufficient amount of fiber fill 204 should be inserted into the pocket so as to provide a cushioning member, and so as to completely fill the pocket, as a partial fill of the pocket would tend to cause the fiber fill to settle into only a portion of the pocket, rather than filling the whole pocket. Balanced against this however is the fact that there is no need to compressively insert fiber fill 204 into the pockets wherein the bumper becomes very hard and rigid. To the contrary, a soft, filled bumper is preferable to a "hard" bumper of the type that might have a hardness similar to the hardness of a wrestling mat.

Although sheet portions 200, 202 are described as "portions" or "members", it will be appreciated that the interior and exterior sheet portions, 200, 202 are preferably made from the same sheet of fabric, as discussed above.

As best shown in FIG. 3, the pocket of the lower bumper member 82 is defined by the interior and exterior sheet portions 200, 210 and a pair of stitching lines, including stitching line 76 and 218, which define respectively, the lower and upper extent of the pocket. One purpose of the stitch lines 76,218 is to maintain the shape of the pocket, and to prevent the fiber fill 204 that is contained in the lower bumper member 82 from migrating out of the pocket formed by the interior and exterior sheet portions 200, 202.

Upper bumper 84 is constructed similarly, and is to include an interior sheet member 208, and exterior sheet member 210 which, along with stitch lines 218, 211, that define a pocket into which a fiber fill 212 is inserted. If desired, a "quilting" can be performed to better maintain the fill in the pockets.

A pair of straps, 214, 216 can be attached to one or both of the lower 82 and upper bumper members. The configuration of the straps 214, 216, and the manner in which they operate, will be described in more detail below.

At the top of the safety bumper 10 is disposed the crowning ruffle 86. The crowning ruffle 86 is also comprised of an interior sheet portion 226 and an exterior sheet portion 228. The apex of the crowning ruffle 86 is a fold line 72.

The crowning ruffle 86 is primarily decorative in purpose, and should be preferably designed to have a ruffle-like appearance. In the embodiment shown in FIG. 3, a pair of stitch lines 211, 230 are provided for keeping the ruffling crown in a thin, linear configuration. Although stitch line 211 is integral to the operation of the device, as it defines the upper most extent of the pocket of the upper bumper 84, stitch line 230 may be dispensed with, if unnecessary to achieve the desired aesthetic effect of the crowning ruffle 86. It will be noted that the interior 226 and exterior 228 sheets are placed against each other, so that the pocket therebetween has no substantial volume. In this regard, the thickness of the ruffle 86 is generally similar to the thickness of the side engaging portion 52.

Figure 6:
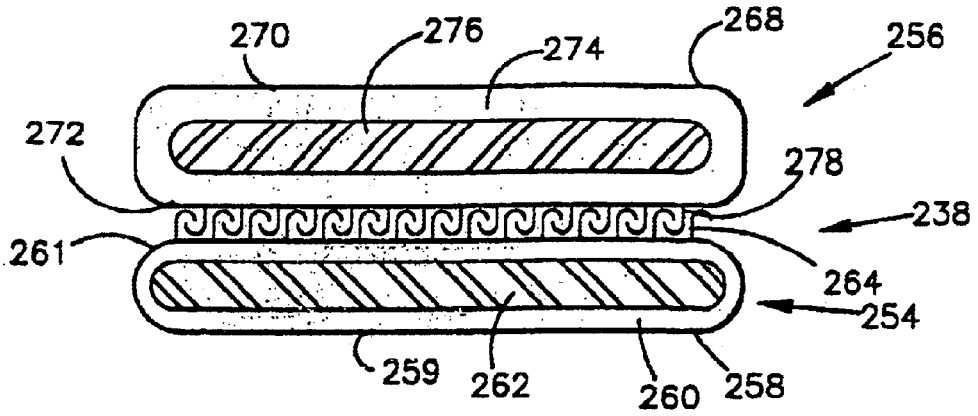
FIG. 6 is a sectional view taken generally along lines 6—6 of FIG. 5.

Turning now to FIGS. 5 and 6, a plurality of strap sets are provided that are fixedly coupled to the bumper portion, and are provided for coupling the bumper portion to the upstanding rails of the headboard 106, footboard 108 and side rails 132, 134 of the crib. The strap sets include a first corner strap set 234, a second corner strap set 236, a third corner strap set 238 and a fourth corner strap set 240.

The first, second, third and fourth corner strap sets, 234, 236, 238 and 240 are designed primarily to extend around the corner bed posts, which, in most cribs are formed as a part of the headboard 106 and footboard 108. Additionally, the bumper pad 10 preferably includes a first side strap set 244 and a second side strap set 246 that, like the first through fourth corner strap sets 234–240, are fixedly coupled at one end to either the first or second bumper pad member 82, 84. Side strap sets 244, 246 are designed to couple the safety bumper 10 to one of the vertically upstanding rails of the side rails 244, 246.

Turning now to FIG. 4, it will be noted that a pair of second side strap sets 246, 247 are employed. Normally, a single strap set at each point (e.g. 244, 246), that are attached to the top bumper 84, is sufficient to secure the bumper pad 10 to the crib 12. However, aesthetic considerations, and considerations relating to additional securing strength may dictate that a pair of strap sets, such as 246, 247 be used at each point.

Further, first and second end strap sets 250, 252 are provided to couple the bumper to a non-corner rail of the headboard 106 and footboard 108 respectively. In this regard, it will be appreciated that many headboards do not have interior rails on the headboard 106 and footboard 108, but rather comprise a solid board. In such cases, the first and second end straps 250, 252 and not necessarily be affixed to any part of the crib 12. Preferably, the corner strap sets 234–240 are attached approximately 2 to 4 inches from the top of the upper bumper pad portion 84; and the side strap sets and end strap sets are attached within the lower third of the upper bumper pad portion 84. This placement makes the strap sets less accessible to babies in the crib.

As best shown in FIG. 5, two different types of strap sets can be employed. In the illustrative embodiment of FIG. 5, the corner strap sets 234–240 are designed to be both elastic, thereby providing variable length, and also to attach to each other through a hook-and-eye type fastener, such as Velcro®, which will be described in more detail below in connection with FIG. 6. On the other hand, the side strap sets 244, 246 and end strap sets 250, 252 are shown to be tie type strap sets that are non-elastic.

Preferably, all of the strap sets are elastic, and are coupled with Velcro, such as is shown with the corner strap sets 234–240. However, the tie strap sets are shown for use in connection with the side strap sets 244, 246 and end strap sets 250, 252 to illustrate the fact that tie strap sets can be employed in lieu of the elastic Velcro strap sets. It should also be noted that it is more critical (although not mandatory) that elastic, Velcro joint strap sets be used with the corner strap sets 234–240. On the other hand, the use of elastic strap sets is not as critical when used in connection with the side and end strap sets 246, 250, 252. The use of elastic is not as critical, since side rails tend to be generally smaller, and more standardized in shape, and relative distance from the mattress, than corner posts.

The construction of the elastic corner straps, such as third corner strap set 238 is best understood with reference to FIGS. 5 and 6. A corner strap set, such as third corner strap set 238 includes a first strap segment 254 and a second strap segment 256, that can be joined together with a hook-and-eye fastener. First strap set segment 254 comprises a fabric tube 258 having a first exterior surface 259 and a second surface 261, that define an interior, hollow pocket 260 in which an elastic member 262 is disposed.

The eye component of a hook-and-eye type (VELCRO®) fastener 264 is sewn or other wise attached to one of the surfaces. In this illustration, it is shown as being attached to the second surface 261. Second strap segment 256 is constructed similarly, as it also comprises a fabric tube 268 having a first major surface 270 and a second major surface 272 that define an interior tubular pocket 274 in which an elastic member 276 is disposed. The hook component of a hook-and-eye (VELCRO) fastener 278 is disposed on the second surface 272. As with most hook-and-eye fasteners, the hook component 278 matingly engages the eye component 264 to join the first and second strap segments 254, 256 into an endless loop, to thereby secure them to a bed post.

The strap segments 254, 256 are constructed in a manner described above to better accommodate a wide variety of bed posts, to thereby make the bumper 10 adaptable to a wide variety of different crib types. As discussed above, many currently manufactured cribs have corner posts that are quite large in cross-section, whereas other are quite small. In order to accommodate bed posts having such varying sizes, it is important that the strap segment 254, 256 have a sufficient length, so that they can be positioned around a bed post while providing a sufficient surface area for their hook 278 and eye 264 components to mate over a sufficiently large surface area to provide a secure connection. Preferably, the "rest" length of each strap segment 254, 256 should be between about 8 and 12 inches for a combined length of 16–24 inches of the entire strap set.

The use of elastic within the strap segments 254, 256 enables the strap segments to have a longer effective length than their rest length when the strap segments are stretched. This ability of the strap segments 254, 256 to increase their length by stretching helps to make the strap segments 254, 256 capable of accepting a wider variety of different sized bed posts, and hence different crib configurations. Similar to the construction of the elastic members 36, 38, the fabric tubes 258, 268 should be sufficiently long enough, so as to accommodate the length of the elastic members 262, 276, when these elastic members are at their fully stretched positions. When the elastic members are in their rest position, they will have a "crinkled" configuration that is illustrated by schematically in FIG. 1 in connection with elastic member 36, 38.

It should be noted that the manner in which the strap segments of the first and second corner strap sets 234, 236 are joined differs from the manner in which the third and fourth corner strap sets 238, 240 are joined. First and second corner strap sets 234, 236 have their hook-and-eye components configured so as to enable the strap to form a ring-like configuration. Although strap sets 238, 240 do form rings, they are more "eye" shaped, in that when joined, the strap segments have "ends" such as 280, where no such end exists with the first and second corner segments 234, 236.

Figure 7:
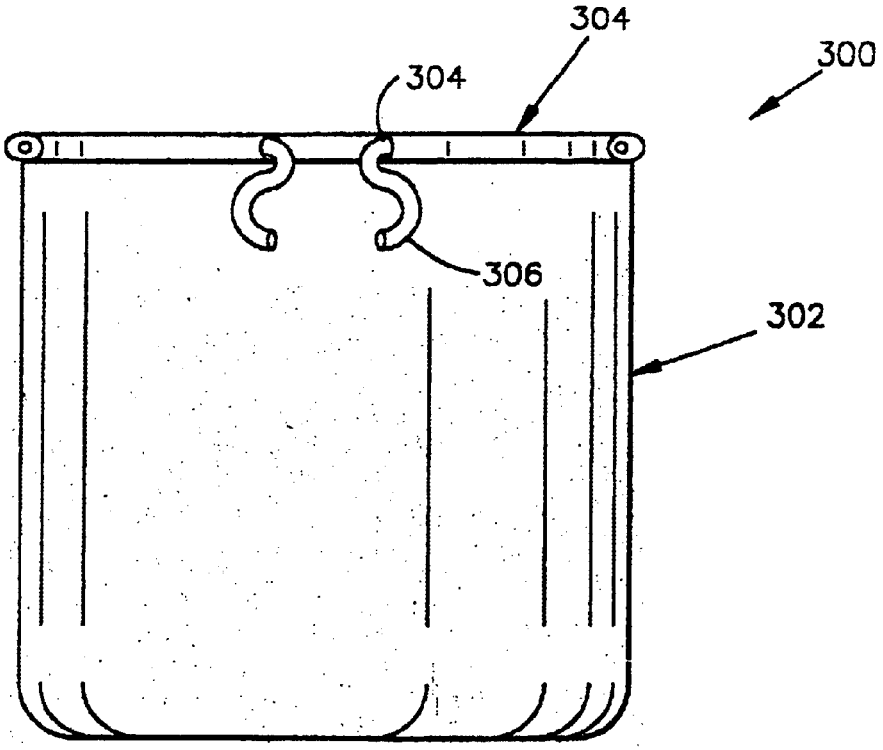
FIG. 7 is a side view of storage bag for the safety bumper of the present invention.
Figure 10:
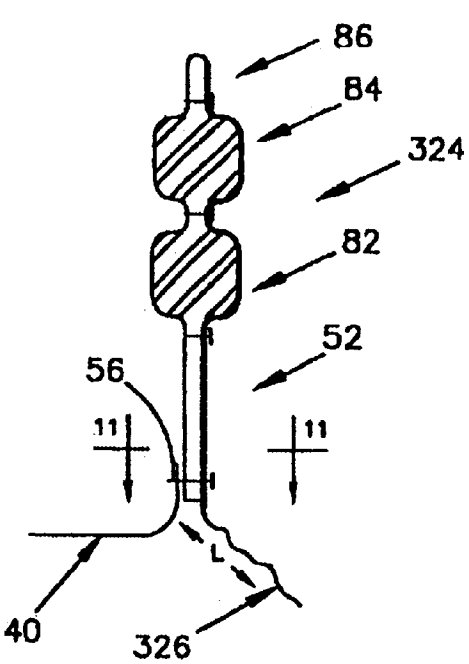
FIG. 10 is a sectional view, similar to FIGS. 8 and 9, showing a third alternate embodiment that includes a removable "sham" attached to the safety bumper.

Turning now to FIG. 7, a sack for encasing the safety bumper 10 of the present invention is shown. The storage sack 300 is a conventional type bag, having a bucket shaped receiving portion 302 having an upper edge 304 that includes a sphincter like closure member that includes a sewn tube 304 containing a string type tie 306. For decorative purposes, this sack 300 may be made out of a material that is similar in appearance to the safety bumper.

Figure 8:
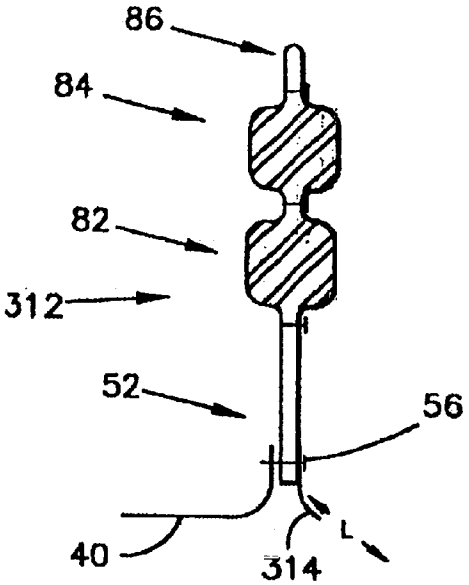
FIG. 8 is a sectional view of the safety bumper of the present invention showing an alternate embodiment containing a small ruffle.

An alternate embodiment safety bumper 12 is shown in FIG. 8. Generally, the construction of the safety bumper 312 of FIG. 8 is identical to the safety bumper 10 described above, with the exception of the fact that the safety bumper 312 includes a short dust ruffle 314 that is attached by stitch line 56.

Figure 9:
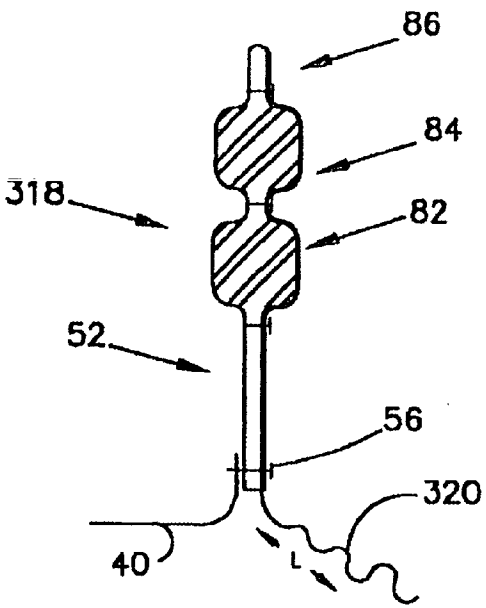
FIG. 9 is a sectional view, similar to FIG. 8, of a second alternate embodiment showing a larger "sham" attached to the safety bumper.

FIG. 9 shows another alternate embodiment, wherein a more full sham 320 is fixedly attached to the dust ruffle by stitch line 56. The primary difference between the small dust ruffle 314 and the large dust ruffle 320 are their respective sizes. For example, the short dust ruffle has a length, measured in the direction L of between about 1 and 4 inches, whereas the length L of the long dust ruffle 320 is typically between about 8 and 16 inches. The dust ruffle 320 is designed to generally extend below the horizontally extending frame 102 of the bed, whereas the dust ruffle 314, may just lie along side of it, and not extend past it.

Figure 11:
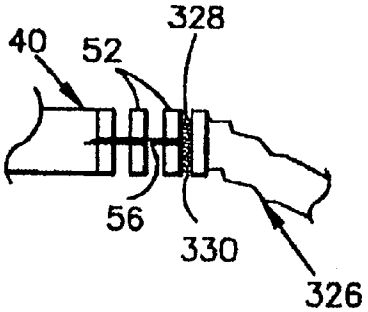
FIG. 11 is a sectional view taken generally along lines 11—11 of FIG. 10.

An additional alternate embodiment is shown in FIG. 11, wherein the large dust ruffle 326 is removably attached to the side edge portion 52 through a hook component 328 (FIG. 11) that is attached to the side edge portion 52, and an eye component 330 that is attached to the large dust ruffle 326. The hook-and-eye components 328, 330 are of a VELCRO® type fastener, similar to the VELCRO® type fastener used with the corner strap sets 234, 240.

Figure 12:
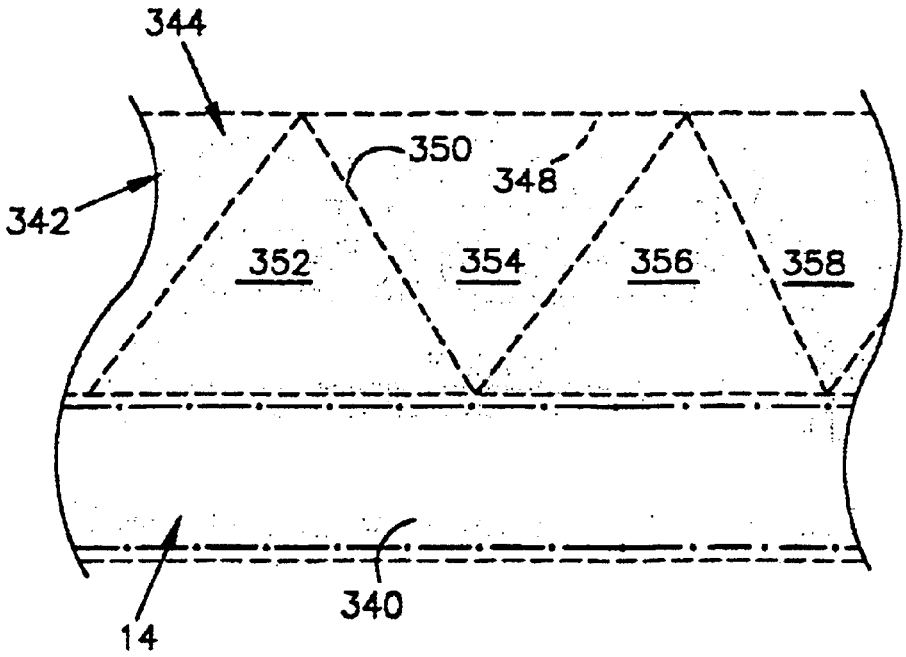
FIG. 12 is a side, partially broken away view showing an alternate embodiment safety bumper pocket forming pattern.

An alternate embodiment bumper pad 338 is shown in FIG. 12, that is generally similar to the other embodiments discussed above, and may or may not include a dust ruffle, as discussed in connection with FIGS. 8–11. Alternate embodiment 338 however, differs in its bumper pad arrangement. The bumper pad arrangement shown in the other embodiments include a first and second 82, 84, generally parallelly disposed bumper pads.

Bumper pad 338 however is constructed differently, and includes side edge portion 340 that is generally similar to the side edge portion of the other embodiment, and a bumper portion 342, and a ruffle crown portion 344. Side edge portion 340 and crown portion 344 are generally similar to the other embodiments. However, bumper portion 342 is different, as it is defined by the area between a lower stitch line 346 and an upper stitch line 348. A zig-zap seam 350 extends in a zig-zag pattern throughout the endless length of the bumper portion 342 to create a plurality of triangular shaped pockets, such as pockets 352, 354, 356, 358, that extend in the generally endless ring, along the entire length of the bumper portion 342.

Figures 13, 14:
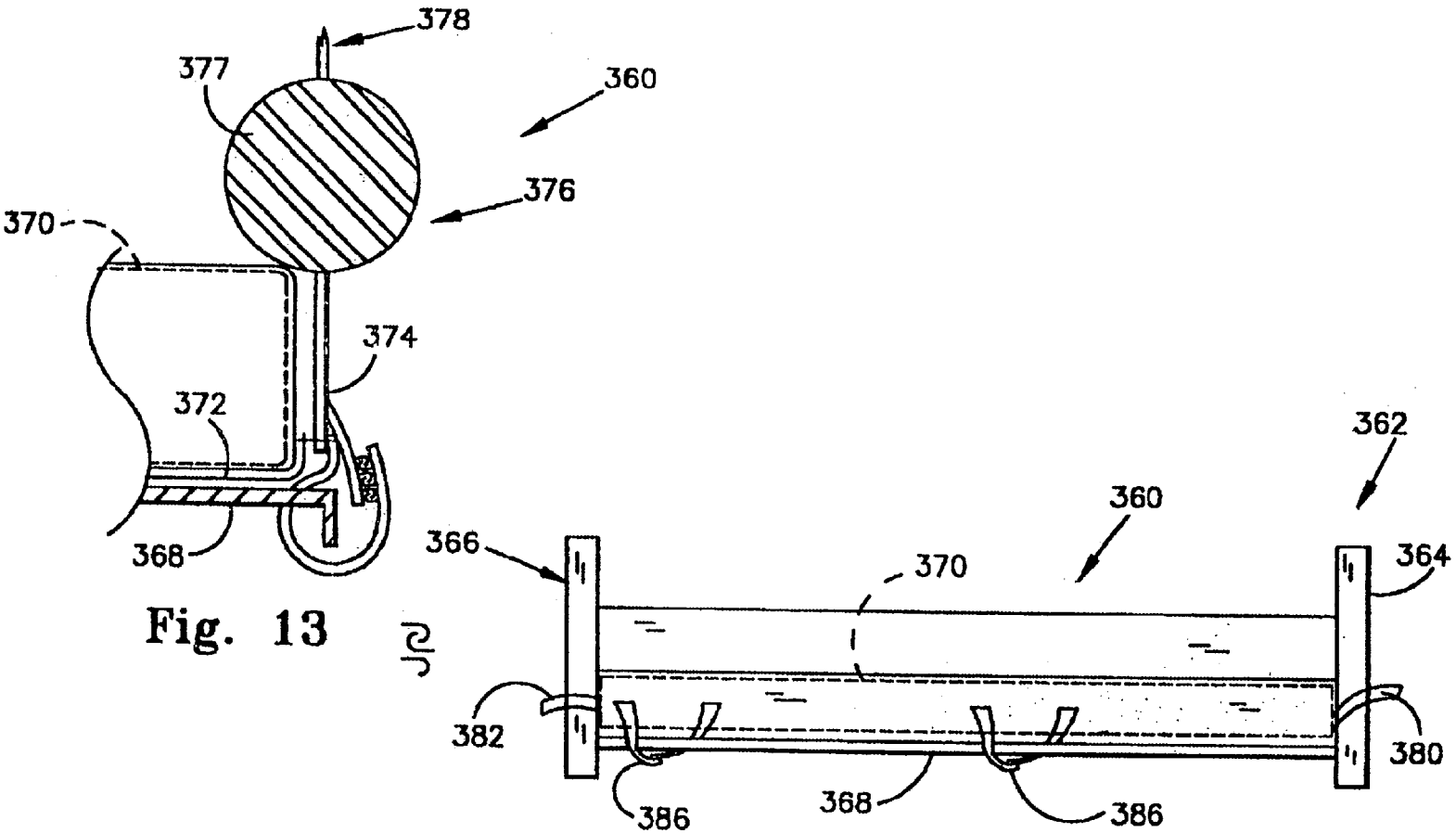
FIG. 13 is a sectional view, similar to FIG. 10, showing an alternate embodiment bumper pad device.
FIG. 14 is a side view of the bumper pad of FIG. 13 installed on a toddler bed.

A alternate embodiment safety bumper pad 360 is shown in FIGS. 13 and 14. Bumper pad 360 is designed for use primarily in connection with toddler beds, rather than cribs, although it will also function with cribs. However, the embodiment shown in FIGS. 1–12 is significantly preferred for use in cribs.

A toddler bed 362 (FIG. 14) is similar to a crib in that it has a headboard 364, a footboard 366 and a mattress supporting frame 368 for supporting a mattress 370. However, unlike a crib, it does not include side rails, or alternately may include a relatively lower, partial side rail that does not extend throughout the entire length of the mattress. The problem posed by the lack of a side rail is to find a way for supporting the bumper portion of the safety bumper 360, and finding an alternate way to attach the sides of the bumper pad 360 to the bed 362.

The alternate embodiment toddler bed bumper pad 360 includes an underside engaging portion 372, a side edge portion 374 and a ruffle crown portion 378 that are virtually identical in most respects to their analogous components in the other embodiments. Additionally, a bumper portion 376 is provided. However, the bumper portion 376 of the toddler safety bumper pad 360 preferably comprises an enlarged, generally cylindrical, endless, unitary tube, rather than comprising the multi-pocket design of the alternate embodiments.

The unitary, wider diameter tube configuration containing appropriate fiber fill 377 is employed because of the nature of a toddler bed. In particular, a toddler bed 362 does not have the side rails to provide vertical support to the bumper portion. As such, the wider diameter bumper pad 360 is more likely to remain in its proper orientation, when compared to the embodiments shown in FIGS. 1–12. Additionally, the toddler bed has no side rails that enables the parent to fix the position of the bumper pad portion 376. This absence of side rails also makes the configuration of the bumper pad portion 376 of the toddler bed better suited for use with a toddler bed because it is unitary, and has a larger dimension.

As best shown in FIG. 14, corner post straps 380, 382 are also provided as a part of the safety bumper pad 360 that are generally similar to their analogous components in the embodiments of FIGS. 1 and 12. However, the absence of side rails requires different side ties.

Side strap sets 386, as shown in FIG. 14, are fixedly coupled to the side engaging portion 374, and are sized, positioned and configured for being coupled to the horizontal mattress supporting frame 368. In their construction, the corner post strap sets 380, 382 and the side tie strap sets 386 are constructed similarly to the corner post strap sets 236, 238, that are discussed in connection with the first embodiment.

Having described the invention in detail with reference to certain preferred embodiments, it will be appreciated that variations and modifications exist within the scope of spirit of the present invention, as defined by the claims appended hereto.

What is claimed is:

1. A safety bumper for use with a child's bed, the safety bumper being receivable by, and placeable on a mattress having an upper surface, an underside surface, first and second opposed side surface and first and second opposed end surfaces, the safety bumper comprising a fitted mattress engaging portion; an elastic member, and a bumper portion, (1) the mattress engaging portion including:

(a) a ring-like underside surface engaging portion for engaging the underside surface of the mattress, the mattress engaging portion defining an opening; and (b) an endless side surface engaging portion for engaging each of the first and second opposed side surfaces and the first and second opposed end surfaces; and (2) the elastic member being capable of extending chordally along the underside surface of the mattress between a pair of opposed points of the mattress engaging portion; and (3) the bumper portion comprising an endless ring capable of being disposed adjacent to the first and second opposed side surfaces and the first and second end surfaces, the safety bumper being configured for extending in planes generally coplanar with the first and second opposed side surfaces and the first and second end surfaces, above the upper side surface of the mattress, the bumper portion including a generally horozontally extending divider for defining at least two pockets for containing a cushioning material, the at least two pockets being configured for providing a substantially endless upstanding cushioning bumper.

2. The safety bumper of claim 1 wherein the safety bumper comprises an endless ring, which when coupled to a mattress, comprises a generally rectangular ring having first, second, third and fourth arcuate corners.

3. The safety bumper of claim 2 further comprising an elastic bed frame engaging strap member attached to the bumper portion adjacent at least one of the first, second, third and fourth corners, the elastic strap member being attachable to a post of a bed frame.

4. The safety bumper of claim 3 wherein the elastic bed frame engaging strap member is stretchable between a rest and a fully stretched position, the bed frame engaging strap member having sufficient elasticity to be able to increase its effective length by at least about three inches between its rest and fully stretched positions, the elastic bed frame engaging strap having a length of between about 14 and 28 ½ inches.

5. The safety bumper of claim 4 wherein the elastic bed frame engaging strap member comprises a first and second elastic bed frame engaging strap segments, the first and second segments each including a first end coupled the bumper position, and a second end for permitting the first and second elastic bed frame engaging segments to be coupled to each other.

6. The safety bumper of claim 4 wherein the second end of the first elastic bed frame engaging segment includes a hook material attached thereto, and the second end of the second elastic bed frame engaging segment includes an eye material attached thereto, the hook material and eye material comprising a hook and eye type material fastener for permitting the first second elastic bed frame engaging segments to be attached to each other.

* * * * *